US007062875B1

(12) United States Patent
Stevens et al.

(10) Patent No.: US 7,062,875 B1
(45) Date of Patent: Jun. 20, 2006

(54) BARREL REPLACEMENT OR INSERT DEVICES FOR FIREARM FUNCTION CONVERSION

(75) Inventors: Wayne Stevens, Davenport, IA (US); Jeff Windham, Bettendorf, IA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 92 days.

(21) Appl. No.: 10/709,964

(22) Filed: Jun. 9, 2004

(51) Int. Cl.
*F41A 21/00* (2006.01)

(52) U.S. Cl. ..... 42/77; 89/29

(58) Field of Classification Search ..... 42/77, 42/76.01; 89/29
See application file for complete search history.

(56) References Cited

U.S. PATENT DOCUMENTS 2,457,354 A * 12/1948 Dial ..... 42/77
2,898,693 A * 8/1959 Ruger ..... 42/77
3,339,304 A * 9/1967 Knode, Jr. et al. ..... 42/77
4,455,777 A * 6/1984 Callies ..... 42/59
4,912,868 A * 4/1990 Thompson ..... 42/77
5,148,620 A * 9/1992 Nelson ..... 42/77

* cited by examiner

*Primary Examiner*—Michael J. Carone
*Assistant Examiner*—Gabriel J. Klein
(74) *Attorney, Agent, or Firm*—Michael C. Sachs; John F. Moran

(57) ABSTRACT

An adapter device is provided for converting a grenade launcher into a weapon for firing shot shells. The adapter includes an elongate barrel member of a gauge for shot shell which is adapted to be received in, and extend through, the barrel of the host barrel assembly of the grenade launcher. A cap secures the barrel member in place in the host barrel assembly. A replacement barrel assembly for firing shot shells is also provided which includes a shell extractor for extracting shells from the replacement barrel.

4 Claims, 2 Drawing Sheets

BARREL REPLACEMENT OR INSERT DEVICES FOR FIREARM FUNCTION CONVERSION

FEDERAL RESEARCH STATEMENT

The inventions described herein may be manufactured, used and licensed by or for the U.S. Government for U.S. Government purposes.

BACKGROUND OF INVENTION

Field of the Invention

The present invention relates to a device for enabling use of a standard firearm such as a grenade launcher for other purposes such as door breaching or other functions normally requiring a separate weapon to carry out that function.

BACKGROUND OF THE INVENTION

The recent war in Iraq as well as other conflicts have made it evident that firearms adapted for use in a more conventional battlefield environment may not be useful for special situations encountered in an urban environment. More specifically, grenade launchers, such as the 40 mm M203 Grenade Launcher, have the disadvantage that the minimum safe range is such that a soldier cannot use the weapon in a number of close-combat situations such as entering a building. In this regard, the minimum safe range of the 40 mm HE used with the M203 Grenade Launcher is 31 meters. Previously, door breaching has not been possible with the M203 Grenade Launcher because ammunition for this purpose does not exist Thus, in general, door breaching in an urban setting cannot be readily accomplished with the weapons soldiers typically carry.

Considering the latter point in more detail, currently, to accomplish breaching of a door, a soldier may carry a separate special stand-alone shotgun. This shotgun would be carried by the soldier in addition to a standard issue weapon, usually a M16 Rifle or a M4 Carbine and thus is an added burden for the solider. Further, it will be appreciated that using a separate shotgun results in undesirable time periods when the soldier does not have a weapon, i.e., during the transition time taken in switching to use of the shotgun and the time taken in switching back from use of the shotgun, and that the soldier is vulnerable during these times.

It is noted that chamber sleeve inserts are commercially available for converting 12 gauge shotguns into smaller gauges, using a very short adapter tube, typically a few inches longer than the shell. These inserts are retained by being a friction fit on the breech.

SUMMARY OF INVENTION

In accordance with the invention, a device is provided for permitting the firing of standard, preferably 12-guage shot shells, using a grenade launcher, such as the M203 Grenade Launcher. The conversion of the grenade launcher so as to be able to serve this purpose is accomplished in one embodiment of the invention, by a complete replacement of the barrel of the grenade launcher and, in another embodiment, by using a barrel insert device which uses the receiver and firing controls of the standard grenade launcher.

In a specific implementation wherein the conversion enables firing of 12-guage ammunition, the invention provides a soldier carrying such a grenade launcher with the ability to quickly convert the weapon so as to enable firing of 12-gauge door breaching rounds, buckshot, less than lethal 12-gauge ammunition or other 12-gauge ammunition, as needed. For the reasons set forth above, this capability would be especially useful in an urban environment. Thus, rather than having to carry an additional weapon, i.e., separate shotgun as described above, a soldier carrying a grenade launcher would only have to change the barrel or use the barrel insert to convert the grenade launcher into a weapon using 12-gauge ammunition. The soldier would, of course, be very familiar with the operation of the basic weapon and, moreover, only a rapid transition would be involved back to the host weapon after, e.g., a shotgun round is fired. In any event, the barrel may be readily changed back to 40 mm when appropriate.

In accordance with one aspect of the invention, there is provided an adapter device for converting a grenade launcher into a weapon for firing shot shells, the grenade launcher including a host barrel assembly including a barrel, a barrel extension adapted to reset the firing mechanism of the grenade launcher and a guide rail adapted to be attached to the receiver rail of the grenade launcher, and the adapter device comprising:

an elongate barrel member of a gauge for shot shell and adapted to be received in, and extend through, the barrel of the host barrel assembly of the grenade launcher, said barrel member including a shell extractor disposed at one end thereof; and a cap adapted to be mounted on the opposite end of said elongate barrel member so as to secure the barrel member in place in the host barrel assembly.

Preferably, the barrel member includes screw threading at said opposite end and said cap member includes mating internal screw threading.

Preferably, the shell extractor includes a spring-biased extractor member.

In an important implementation, the elongate barrel member comprises a 12 gauge barrel.

In accordance with a further aspect of the invention, there is provided a replacement barrel assembly for firing shot shells adapted to replace the barrel assembly of a host grenade launcher including a firing mechanism and a receiver rail, said replacement barrel assembly comprising:

a replacement barrel of a gauge suitable for shot shells;

a barrel extension mounted on the replacement barrel and adapted, in use, to reset the firing mechanism of the firing mechanism at the host grenade launcher;

a guide rail mounted on the replacement barrel and adapted to be attached to the receiver rail of the grenade launcher; and a shell extractor mounted on the replacement barrel for extracting shells from the replacement barrel.

Further features and advantages of the present invention will be set forth in, or apparent from, the detailed description of preferred embodiments thereof which follows.

DETAILED DESCRIPTION

Figure 1:
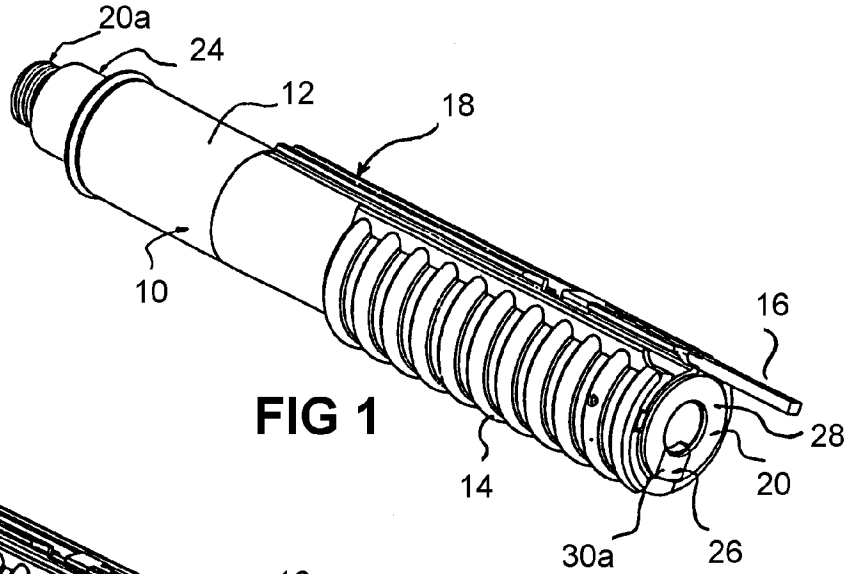
FIGS. 1 and 2 are, drawn to different scales, a perspective view and an exploded perspective view, respectively, of an adapter device in accordance with a first preferred embodiment of the invention.
Figure 2:
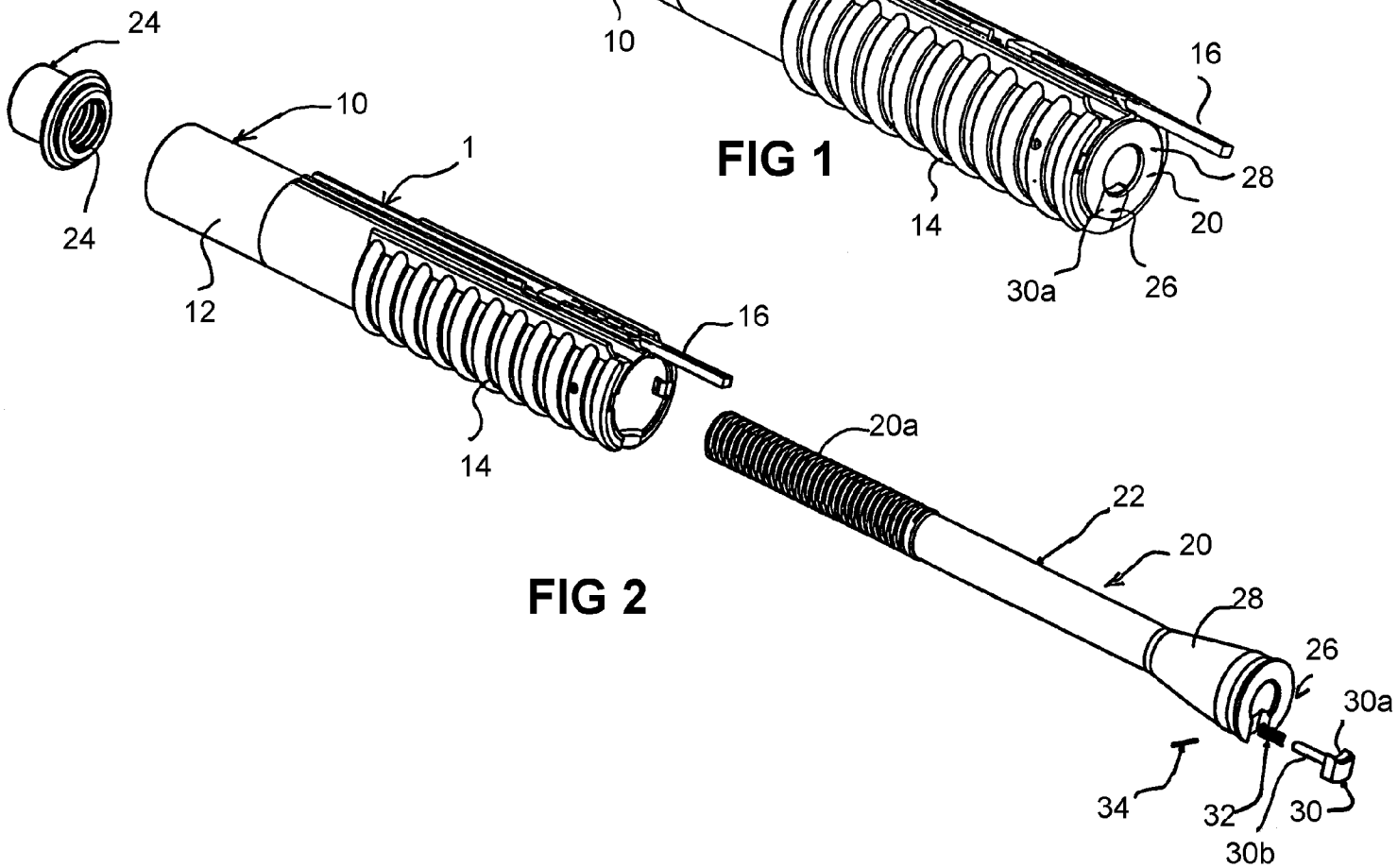

Referring to FIGS. 1 and 2, there is shown a first preferred embodiment of the invention. In this embodiment, a two-piece barrel insert is used to convert the existing or host barrel assembly, denoted 10, into a barrel having the capability of firing shot shell ammunition. Barrel assembly 10 is a conventional barrel used on a 40 mm M203 Grenade Launcher and includes a barrel 12, a hand grip 14, a barrel extension 16 which is used to reset the firing mechanism of the M203 Grenade Launcher and a guide rail 18 which enables attachment of the barrel assembly 10 to the receiver rail of the M203 grenade launcher. Again, barrel assembly 10 is completely conventional and thus will not be further described.

As indicated above, the adapter or insert device of this embodiment includes two basic components, a barrel insert 20 which includes a 12 gauge barrel portion 22 and is breech inserted, which barrel 20 extends through and beyond both ends of the host barrel, and a barrel cap 24 which includes the threading indicated at 24*a* that is adapted to be threaded onto corresponding threading 20*a* on barrel insert 20. The barrel cap 24 includes a flange and a hollow circumferential step on one end to enable the cap to insert into the host grenade launcher barrel 12 and secure the tapered distal end 28 of barrel insert 20 inside the host barrel.

A shell extractor 26 is provided at the tapered distal end 28 of barrel insert 20. As shown in FIG. 2, shell extractor 26 includes a shell extractor member 30 including a headed end 30*a* and a shaft portion 30*b*, extractor coil spring 32 which fits around shaft portion 30*b* and engages headed end 30*a*, and a retaining pin 34.

The extractor member 30 of shell extractor 26 is biased or powered by spring 32 at all times. When the weapon is open for loading, the extractor member 30 is held in an open and rearward position by spring pressure. This action will pull either a fired or unfired shell free from the chamber. The force or pressure exerted by spring 32 has the added benefit of keeping the rear face of the shell against the breech force of the M230 Grenade Launcher when the action is closed with a shell loaded. This ensures correct and reliable functioning of the weapon's firing pin to fire the shell.

Figure 3:
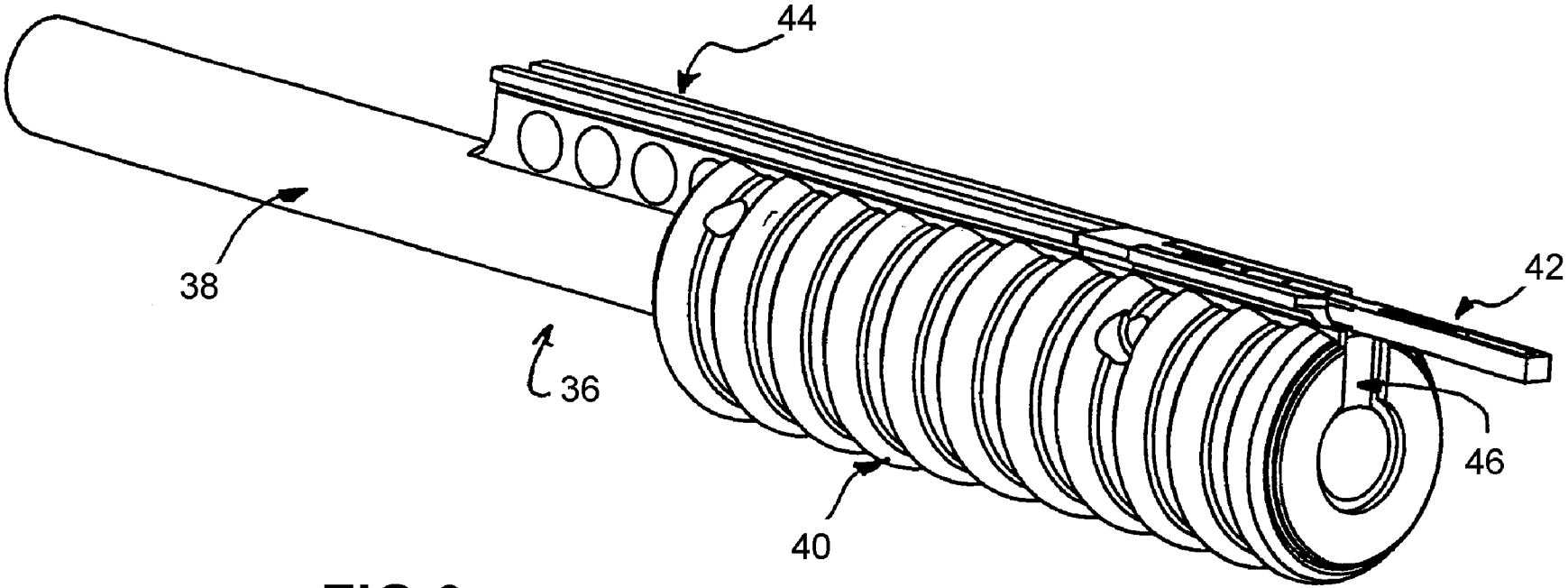
FIG. 3 is a perspective view of a replacement barrel assembly in accordance with a further embodiment of the invention.

Referring to FIG. 3, a second embodiment of the invention is shown. In this embodiment, a barrel assembly, generally denoted 36, is provided which completely replaces the existing barrel assembly (shown at 10 in FIGS. 1 and 2). The replacement barrel 36 includes, in common with the existing barrel assembly, a barrel 38, a hand grip 40, a barrel extension 42, and a guide rail 44. A shell extractor 46 is also provided which is similar to shell extractor 26 of FIGS. 1 and 2 but is oriented in an uppermost orientation as opposed to lowermost orientation of shell extractor 26. The orientation of shell retractor 46 creates more room at the bottom side of the replacement barrel assembly.

As in the conventional barrel assembly 10 of FIGS. 1 and 2, the barrel extension 42 resets the firing mechanism of the M203 Grenade Launcher while guide rail 44 provides for attachment of the barrel assembly 36 to the receiver rail of the M203 Grenade Launcher.

In a specific non-limiting embodiment, barrel 38 is a 12 gauge barrel with a chamber for a 2¾" shell and is 14" in length.

The barrel assembly of FIG. 3 can be used with any configuration of the M203 Grenade Launcher. Moreover, the basic approach underlying the barrel adapter or insert embodiment of FIGS. 1 and 2 could be used to convert the caliber of most break-action types of grenade launchers or firearms. Barrels other than 12 gauge barrels can be used, including 10, 16, 20 and 28 gauges as well as 0.410 gauges. However, a 12 gauge barrel is important as 12 gauge shotguns are standard military issue so that ammunition is readily available.

Although the invention has been described above in relation to preferred embodiments thereof, it will be understood by those skilled in the art that variations and modifications can be effected in these preferred embodiments without departing from the scope and spirit of the invention.

The invention claimed is:

1. An adapter device for converting a grenade launcher into a weapon for firing shot shells, the grenade launcher including a host barrel assembly including a barrel, a barrel extension adapted to reset the firing mechanism of the grenade launcher and a guide rail adapted to be attached to the receiver rail of the grenade launcher, and said adapter device comprising:

a unitary elongate barrel member of a gauge for shot shell and adapted to be received in, and to extend through and beyond both ends of the barrel of the host barrel assembly of the grenade launcher, said barrel member including a shell extractor disposed at a tapered end thereof and is biased in an open position; and a cap adapted to be mounted on an opposite end of said elongate barrel member, wherein the cap includes a hollow circumferential step that is adapted for insertion into the barrel of the host barrel assembly to secure the barrel member in place in the host barrel assembly.

2. A device as claimed in claim 1 wherein said barrel member includes screw threading at said opposite end and said cap member includes mating internal screw threading.

3. A device as claimed in claim 1 wherein the shell extractor includes a spring-biased extractor member that is held in an open and rearward position by spring bias.

4. A device as claimed in claim 1 wherein said elongate barrel member comprises a 12 gauge barrel.

* * * * *